US005343704A

United States Patent [19]

Kanzaki et al.

[11] Patent Number: 5,343,704

[45] Date of Patent: Sep. 6, 1994

[54] DOUBLE-HEADED AND SWASH PLATE TYPE STIRLING ENGINE

[75] Inventors: Shigeki Kanzaki; Tatsuyuki Hoshino; Kunifumi Goto, all of Kariya, Japan

[73] Assignee: Kabushiki Kaisha Toyoda Jidoshokki Seisakusho, Kariya, Japan

[21] Appl. No.: 17,624

[22] Filed: Feb. 12, 1993

[30] Foreign Application Priority Data

Feb. 21, 1992 [JP] Japan ..... 4-34890

[51] Int. Cl.[5] ..... F02G 1/043

[52] U.S. Cl. ..... 60/525; 60/517

[58] Field of Search ..... 60/525, 517, 24; 62/403, 6

[56] References Cited

U.S. PATENT DOCUMENTS 4,030,404 6/1977 Meijer ..... 60/525
4,495,771 1/1985 Chauveton ..... 60/517
4,698,970 10/1987 Hashimoto ..... 60/525
4,977,742 12/1990 Meijer ..... 60/525

FOREIGN PATENT DOCUMENTS 0074190 5/1952 Denmark ..... 60/24
2-207164 8/1990 Japan .
3-74552 3/1991 Japan .

*Primary Examiner*—Tony M. Argenbright
*Assistant Examiner*—M. Macy
*Attorney, Agent, or Firm*—Brooks Haidt Haffner & Delahunty

[57] ABSTRACT

A double-headed swash plate type Stirling engine includes double headed pistons defining front spaces and rear spaces and anchored to the swash plate by shoes. Thus, the reciprocal movement of the double-headed pistons, resulting from the expansion and compression of an operating gas in the front and rear spaces, are directly converted into the rotary movement of the swash plate. Hence, the Stirling engine has a very simplified construction.

14 Claims, 5 Drawing Sheets

DOUBLE-HEADED AND SWASH PLATE TYPE STIRLING ENGINE

BACKGROUND OF THE INVENTION

Field of the Invention

The present invention relates to a multiple-acting and multiple-piston type Stirling engine. More particularly, it relates to a double-headed and swash plate type Stirling engine which can be adapted to be a prime mover, a cooler or a heater.

Description of the Related Art

Japanese Unexamined Patent Publication (KOKAI) No. 2-207,164 and Japanese Unexamined Patent Publication (KOKAI) No. 3-74,552 describe a conventional Stirling Engine. As illustrated in FIG. 5, the conventional Stirling Engine comprises a cylinder block 610 including four bores 611 (Three of them are not shown.), a combustion housing 700 fixed to the cylinder block 610, and an operating piston 620 disposed reciprocally in each of the four bores 611. Further, each of the operating pistons 620 is connected to an end of a piston rod 630 which is disposed slidably with respect to the cylinder block 610 by way of a pair of bushings 631 and 632. Each of the piston rods 630 is installed to a guide piston 640 at the other end by way of a nut 633. Each of the guide pistons 640 is disposed reciprocally in a guide bore 650, a swash plate 660 is installed to each of the guide pistons 640 by way of a pair of shoes 661 and 661, and an output shaft 670 is fixed to the swash plate 660 so as to take out output to the outside. Furthermore, each of the bores 611 is divided into an expansion space 612 and a compression space 613 by the ends of the operating piston 620, and the expansion spaces 612 are connected to the compression spaces 613 which are disposed off by a phase difference of 90° by a connecting pipe (not shown) which includes a regenerator disposed between the expansion spaces 612 and the compression spaces 613 and filled with a heat accumulator. Moreover, the connecting pipes are disposed adjacent to the combustion housing 700, which is heated by a heat source (not shown), on the sides of the expansion spaces 612, and they are disposed adjacent to the cooler 800, which is cooled by circulating cooling water in the cooler 800, on the sides of the compression spaces 613.

In the conventional Stirling engine, an operating gas such as a helium gas or the like is sealed in the expansion spaces 612, the compression spaces 613 and the connecting pipes. The Stirling engine is started by actuating the heat source in the combustion chamber 700 and by circulating the cooling water in the cooler 800. Then, the operating gas is subjected to the heating at a constant volume and thereafter the expansion at a constant temperature in the expansion spaces 612 and in the connecting pipes on the sides of the expansion spaces 612, and it is subjected to the cooling at a constant volume and thereafter the compression at a constant temperature in the compression spaces 613 and in the connecting pipes on the sides of the compression spaces 613. As a result, the operating gas in the expansion spaces 612 moves the operating pistons 620 in the expanding direction in the bores 611, and the operating gas in the compression spaces 613 moves the operating pistons 620 in the compressing direction in the bores 611. At this moment, the operating gas heated in the expansion spaces 612 transfers to the compression spaces 613 through the connecting pipes, and the heat accumulator filled in the regenerators takes away the heat from the heated operating gas. At the same time, the operating gas cooled in the compression spaces 613 transfers to the expansion spaces 612 through the connecting pipes, and the heat accumulator filled in the regenerator gives off its heat to the cooled operating gas. By thusly operating the operating pistons 612, the piston rods 630 are slid reciprocally with respect to the cylinder block 610, and the guide pistons 640 are moved in the same direction. All in all, the swash plate 660 is rotated by way of the shoes 661 and 661, and accordingly the output shaft 670 is rotated.

However, the conventional Stirling engine requires not only the operating pistons 620, which define the expansion spaces 612 and the compression spaces 613 and which produce the reciprocal movement, but also the guide pistons 640, which convert the reciprocal movement of the operating pistons 620 into the rotary movement of the swash plate 660 by way of the guide pistons 640. Thus, the conventional Stirling engine is complicated in the construction, and accordingly it is heavy-weighted and enlarged.

The conventional Stirling engine is classified into the multiple-acting and multiple-piston type. In addition, there have been known a large variety of Stirling engines classified into the other types, for example, one-cylinder type, two-cylinder type, multiple-acting type, free-piston type, single-acting and two-piston type, multiple-acting and two piston type Stirling engines, and these Stirling engines suffer from the same drawback as well.

SUMMARY OF THE INVENTION

It is therefore an object of the present invention to simplify the construction of Stirling engine.

A double-headed and swash plate type Stirling engine according to the present invention comprises:

- a cylinder block including a heat insulator disposed at a central portion in an axial direction, an axial central hole, a plurality of bores disposed in parallel with the axial central hole, and a swash plate chamber formed therein and opened to a center of the bores;
- a front housing enclosing a front end of the cylinder block;
- a rear housing enclosing a rear end of the cylinder block;
- a shaft rotatably disposed in the axial central hole of the cylinder block;
- a swash plate fixed to the shaft, and disposed rotatably in the swash plate chamber of the cylinder block;
- a plurality of double-headed pistons installed to the swash plate by way of shoes, and disposed reciprocally in the bores of the cylinder block;
- a plurality of front spaces formed by the front housing, the bores and a front end of the double-headed pistons in the cylinder block, and containing an operating gas therein;
- a plurality of rear spaces formed by the rear housing, the bores and a rear end of the double-headed pistons in the cylinder block, and containing the operating gas therein;
- a first heat exchanger adapted for carrying out heat exchange around the front spaces;
- a second heat exchanger adapted for carrying out heat exchange around the rear spaces; and a plurality of connecting pipes connecting the front spaces to the rear spaces with a predetermined phase difference and a constant volume, and including a heat accumulator disposed between the front spaces and the rear spaces.

Further, in the case that the shaft is adapted to an output shaft, the first heat exchanger is adapted for heating the front spaces, and the second heat exchanger is adapted for cooling the rear spaces, the present double-headed and swash plate type Stirling engine can be operated as a prime mover.

Furthermore, in the case that the shaft is adapted to a driving shaft, the first heat exchanger is adapted for radiating the heat of the front spaces (or being cooled by the front spaces), and the second heat exchanger is adapted for receiving the heat of the rear spaces (or being heated by the rear spaces), the present double-headed and swash plate type Stirling engine can be operated as a cooler or a heater.

Thus, in the present double-headed and swash plate type Stirling engine, the double-headed pistons defining the front spaces produce the reciprocal movement, and they are installed to the swash plate by way of the shoes so as to carry out the conversion of the reciprocal movement into the rotary movement of the swash plate. Hence, the present Stirling engine can achieve the simplification of the conventional Stirling engine intended as above. As a result, in accordance with the present Stirling engine, the light-weight and the down-size requirements can be satisfied. In addition, the number of the components parts can be reduced in the present Stirling engine, because the operating pistons 620 and the piston rods 630 and the like of the conventional Stirling engine are obviated in the present Stirling engine.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

The First Preferred Embodiment according to the present double-headed and swash plate type Stirling engine will be hereinafter described by reference to the accompanying FIGS. 1, 2 and 3, and it is embodied as a Stirling prime mover.

Figure 1:
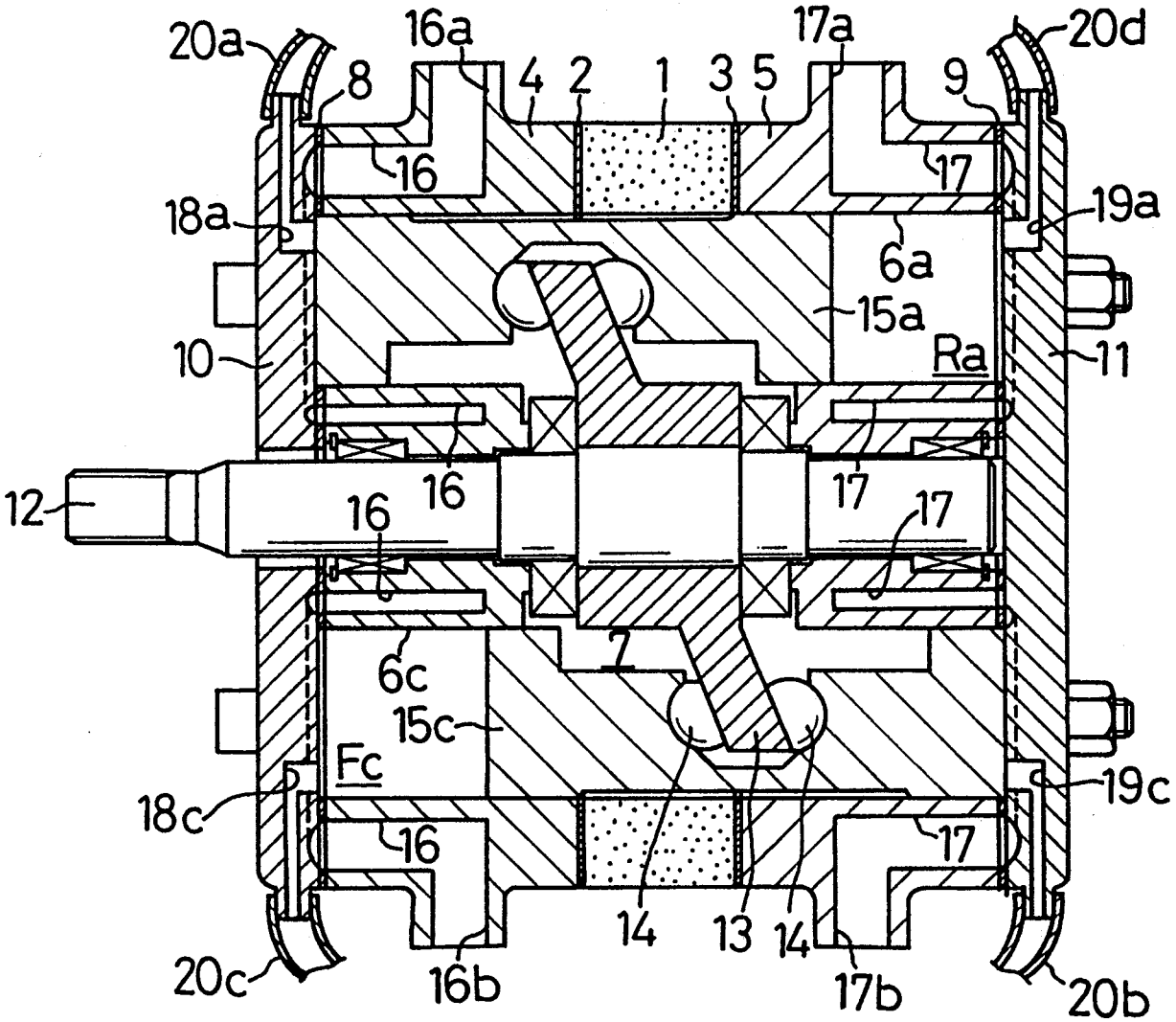
FIG. 1 is a vertical cross-sectional view of First and Second Preferred Embodiments according to the present double-headed and swash plate type Stirling engine.
Figure 2:
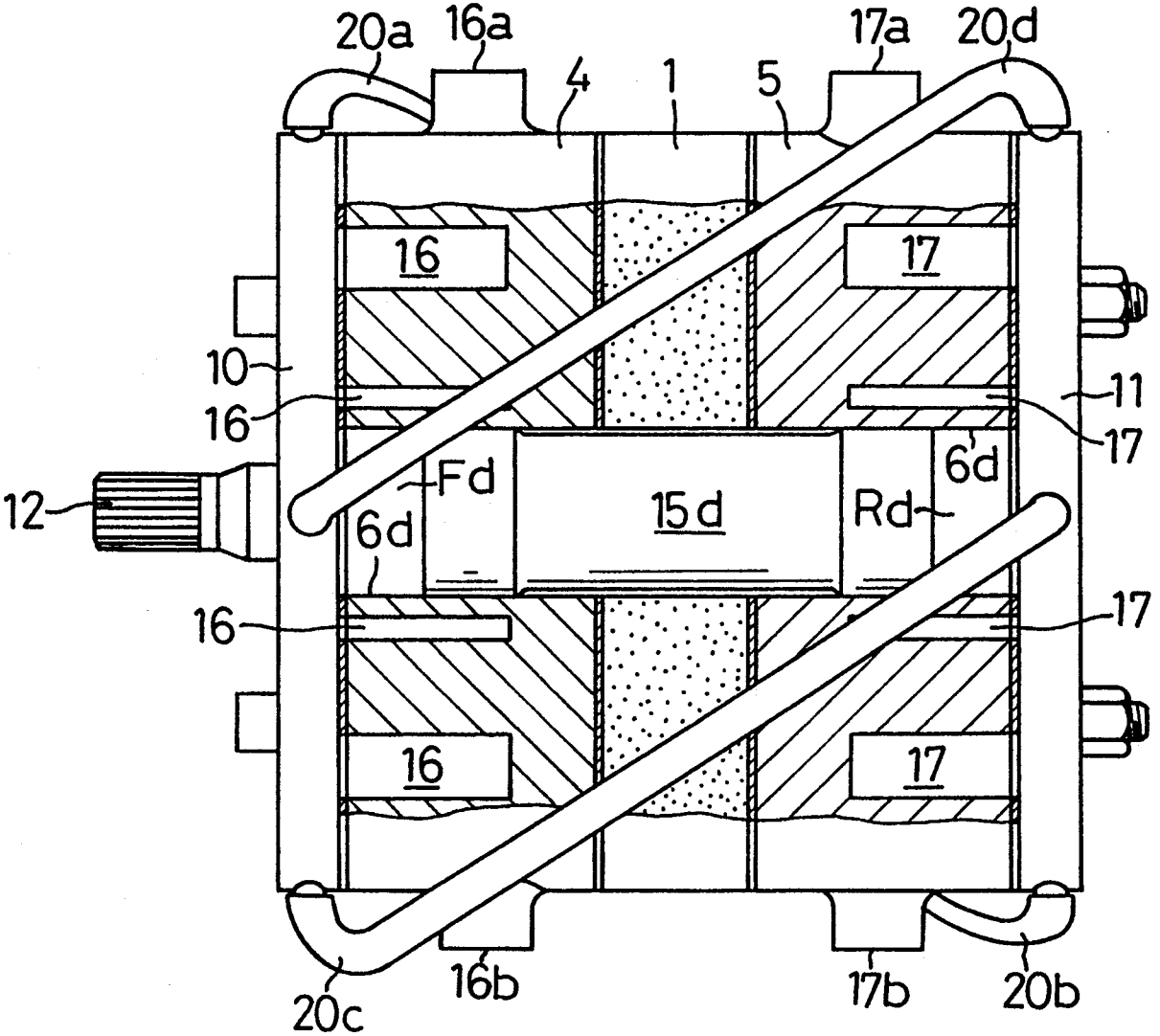
FIG. 2 is a side view of the First and Second Preferred Embodiments, partly in cross-section.

As illustrated in FIGS. 1 and 2, in the Stirling prime mover, a heat insulator 1 made of ceramics is disposed between a pair of front and rear cylinder blocks 4 and 5 made of metal by way of a pair of gaskets 2 and 3 at the central portion in the axial direction of the front and rear cylinder blocks 4 and 5. As schematically illustrated in FIG. 3, in the heat insulator 1 and the front and rear cylinder blocks 4 and 5, there are formed four bores *6a*, *6b*, *6c* and *6d* which are disposed in parallel with and around an axial central hole. Turning now back to FIG. 1, at the connection between the heat insulator 1 and the front and rear cylinder blocks 4 and 5, there is formed a swash plate chamber 7 which is opened to a center of the bores *6a* through *6d*. The front and rear cylinder blocks 4 and 5 are enclosed at the external ends by a front housing 10 and a rear housing 11, respectively, by way of s pair of gaskets 8 and 9.

In the axial central hole of the front and rear cylinder blocks 4 and 5, there is disposed an output shaft 12 rotatable by way of radial bearings and sealing devices. The output shaft 12 is further disposed so as to penetrate through the front housing 10. A swash plate 13 is fixed around the output shaft 12 so as to be disposed rotatably in the swash plate chamber 7, and it is held between the front and rear cylinder blocks 4 and 5 by way of thrust bearings.

In the bores *6a* through *6d*, there are disposed double-headed pistons reciprocating *15a* through *15d* (Two of which are not shown in FIG. 1.) which are coupled to the swash plate 13 by a pair of shoes 14 and 14. As can be understood from FIGS. 1 and 3, there are formed four front spaces Fa, Fb, Fc and Fd by the front end of the double-headed pistons *15a* through *15d*, the bores *6a* through *6d* and the front housing 10 in the front cylinder block 4, and there are formed four rear spaces Ra, Rb, Rc and Rd by the rear end of the double-headed pistons *15a* through *15d*, the bores *6a* through *6d* and the rear housing 11 in the rear cylinder block 5.

In the front cylinder block 4 and the front housing 10, there is formed a first jacket 16, which communicates the inlet port *16a* with the outlet port *16b* and covers around the front spaces Fa through Fd, as a first heat exchanger. Heated steam is circulated in the first jacket 16 so as to operate the first jacket 16 as a heater. Likewise, in the rear cylinder block 5 and the rear housing 11, there is formed a second jacket 17, which communicates the inlet port *17a* with the outlet port *17b* and covers around the rear spaces Ra through Rd, as a second heat exchanger. Cooling water is circulated in the second jacket 17 so as to operate the second jacket 17 as a cooler.

Figure 3:
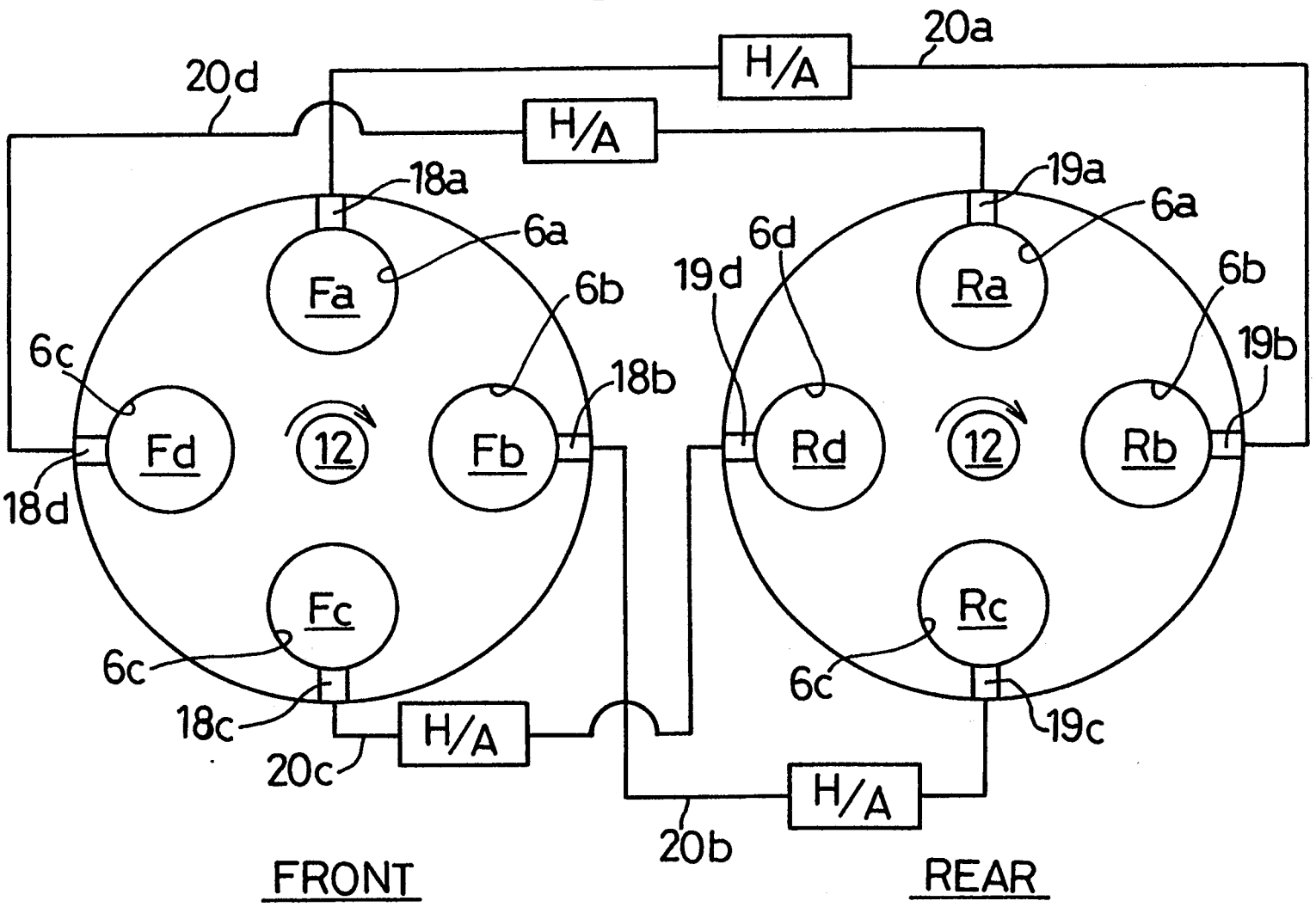
FIG. 3 is a block diagram schematically illustrating the First and Second Preferred Embodiments.

As illustrated in FIGS. 1 and 3, in the front housing 10, there are formed four ports *18a*, *18b*, *18c* and *18d* which are respectively connected to the front spaces Fa, Fb, Fc and Fd. Likewise, in the rear housing 11, there are formed four ports *19a*, *19b*, *19c* and *19d* which are respectively connected to the rear spaces Ra, Rb, Rc and Rd.

As shown in FIG. 3, the front space Fa is connected to the rear space Rb, which is constituted by the bore *6b* disposed next to the bore *6a* constituting the front space Fa, with a phase difference of 90° by a connecting pipe *20a* by way of the ports *18a* and *19b*. Further, as also shown in FIG. 3, the front space Fb is connected to the rear space Rc, which is constituted by the bore *6c* disposed next to the bore *6b* constituting the front space Fb, with a phase difference of 90° by a connecting pipe 20*b* by way of the ports 18*b* and 19*c*. Furthermore, as also shown in FIG. 3 and best illustrated in FIG. 2, the front space Fc is connected to the rear space Rd, which is constituted by the bore 6*d* disposed next to the bore 6*c* constituting the front space Fc, with a phase difference of 90° by a connecting pipe 20*c* by way of the ports 18*c* and 19*d*. Moreover, as also shown in FIG. 3 and best illustrated in FIG. 2, the front space Fd is connected to the rear space Ra, which is constituted by the bore 6*a* disposed next to the bore 6*d* constituting the front space Fd, with a phase difference of 90° by a connecting pipe 20*d* by way of the ports 18*d* and 19*d*.

In addition, a metallic mesh or the like is disposed and filled in the middle of the connecting pipes 20*a* through 20*d* as a heat accumulator. In particular, all of the following total volumes are made identical: the total volume of the front space Fa and the rear space Rb thusly connected, the total volume of the front space Fb and the rear space Re thusly connected, the total volume of the front space Fc and the rear space Rd thusly connected, and the total volume of the front space Fd and the rear space Ra thusly connected.

In the Stirling prime mover thusly constructed, a helium gas is sealed in the front spaces Fa through Fd, the rear spaces Ra through Rd and the connecting pipes 20*a* through 20*d*, as an operating gas. The Stirling prime mover is started by circulating the heated steam in the first jacket 16 and by circulating the cooling water in the second jacket 17. Then, the operating gas is subjected to the heating at a constant volume and thereafter the expansion at a constant temperature in the front space Fa and in the connecting pipe 20*a* on the side of the front space Fa. Consequently, as can be understood from FIG. 1, the operating gas in the front space Fa moves the piston 15*a* in the expanding direction in the bore 6*a*. At the same time, the operating gas is subjected to the cooling at a constant volume and thereafter the compression at a constant temperature in the rear space Ra and in the connecting pipe 20*d* on the side of the rear space Ra. Consequently, the operating gas in the rear space Ra moves the piston 15*a* in the compressing direction in the bore 6*a*. At this moment, as illustrated in FIG. 3, the operating gas heated in the front space Fa transfers to the rear space Rb, which is disposed off the front space Fb in advance by a phase difference of 90°, through the connecting pipe 20*a*, and the heat accumulator takes away the heat from the heated operating gas. At the same time, as illustrated in FIGS. 3 or 2, the operating gas cooled in the rear space Ra transfers to the front space Fd, which is disposed off the rear space Ra in retract by a phase difference of 90°, through the connecting pipe 20*d*, and the heat accumulator gives off its heat to the cooled operating gas. As can be understood from FIG. 3, the word "advance" or "retract" herein means the advancement or the retraction in the clockwise direction when the output shaft 12 rotates in the same direction. Here, FIG. 3 is a block diagram which views both of the front spaces Fa through Fd and the rear spaces Ra through Rd on the side of the front housing 10.

The piston 15*a* is moved in the aforementioned manner, and the pistons 15*b*, 15*c* and 15*d* are moved similarly, but with a phase difference of 90°, 180° and 270° with respect to the piston 15*a*, respectively. By thusly operating the pistons 15*a* through 15*d*, the swash plate 13 is rotated by way of the shoes 14 and 14, and accordingly the rotation of the output shaft 17 is used for motive force.

In the First Preferred Embodiment according to the present double-headed and swash plate type Stirling engine having been described so far, since the double-headed pistons 15*a* through 15*d* define the front spaces Fa through Fd and the rear spaces Ra through Rd and they are installed to the swash plate 13 by way of the shoes 14 and 14, the reciprocal movement of the pistons 15*a* through 15*d* are directly converted into the rotary movement of the swash plate 13. Thus, the First Preferred Embodiment has a very simplified construction compared with that of the conventional Stirling engine in which the operating pistons 620, the piston rods 630 and the guide pistons 650 are employed.

Second Preferred Embodiment

Figure 4:
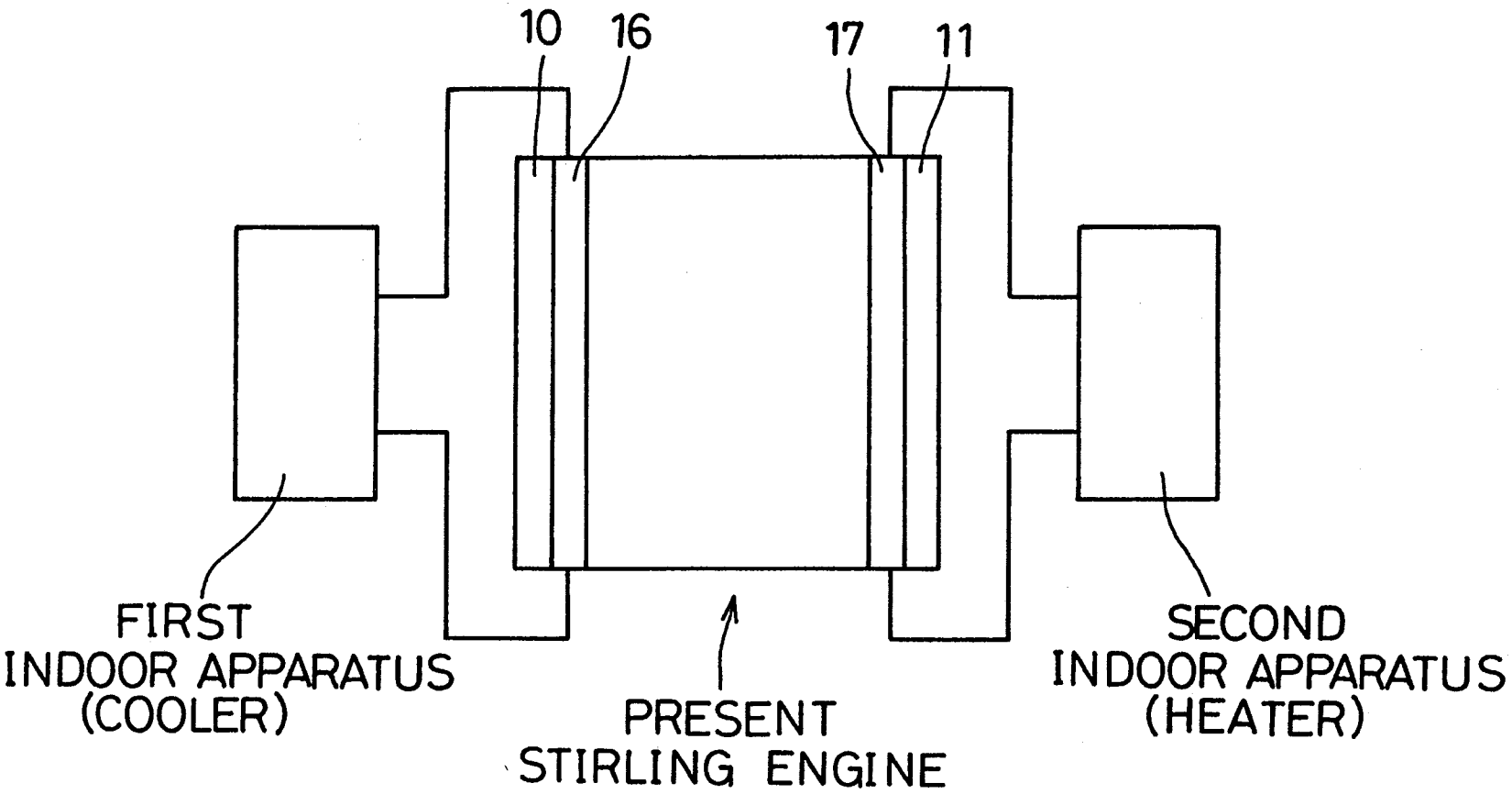
FIG. 4 is a block diagram schematically illustrating the Second Preferred Embodiment.
Figure 5:
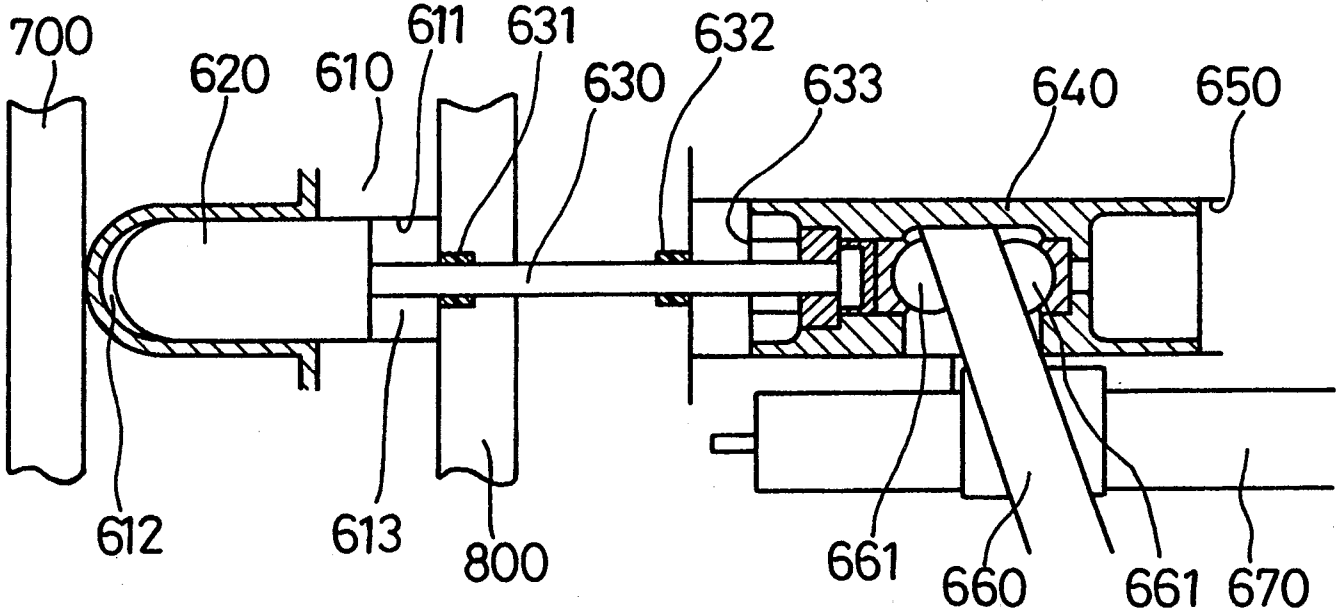
Fig. 5 (PRIOR ART)
FIG. 5 is a schematic vertical cross-sectional view of the conventional Stirling Engine.

As illustrated in FIG. 4, the Second Preferred Embodiment according to the present double-headed and swash plate type Stirling engine is embodied as a Stirling cooler and heater. The Stirling cooler and heater has an identical construction with that of the First Preferred Embodiment except that the output shaft 12 is adapted to a driving shaft, the first jacket 16 formed around the front spaces Fa through Fd is adapted for radiating the heat of the front spaces Fa through Fd (or being cooled by the front spaces Fa through Fd), and the second jacket 17 formed around the rear spaces Ra through Rd is adapted for receiving the heat of the rear spaces Ra through Rd (or being heated by the rear spaces Ra through Rd). Accordingly, the construction and operation of the Stirling cooler and heater will be hereinafter described by using the same FIGS. 1, 2 and 3, and the same component members will be designated at the same reference numerals.

In the Stirling cooler and heater, ordinary temperature water is circulated in the first jacket 16 instead of the heated steam of the First Preferred Embodiment. As illustrated in FIG. 4, the ordinary temperature water is further circulated between the first jacket 16 and a first indoor apparatus disposed in a room in which cooling is desired. Another ordinary temperature water is circulated in the second jacket 17 instead of the cooling water of the First Preferred Embodiment. As also illustrated in FIG. 4, the another ordinary temperature water is further circulated between the second jacket 17 and a second indoor apparatus disposed in a room in which heating is desired.

Turning now to FIG. 1, in the Stirling cooler and heater thusly constructed, the driving shaft 12 is actuated by a driving source (not shown) after the operating gas is sealed. Then, the swash plate 13 is rotated, and the pistons 15*a* through 15*d* are moved reciprocally by way of the shoes 14 and 14 in the bores 6*a* through 6*d*. When the pistons 15*a* through 15*d* are thusly reciprocated, the operating gas in the front spaces Fa through Fd is expanded in this order, and the operating gas in the rear spaces Ra through Rd is compressed in this order. As a result, the ordinary temperature water circulating in the first jacket 16 formed around the front spaces Fa through Fd is taken away its heat, and thereby it is cooled. On the other hand, heat is given off to the another ordinary temperature water circulating in the second jacket 17 formed around the rear spaces Ra through Rd, and thereby it is heated. At this moment, as illustrated in FIG. 3, the operating gas in the front spaces Fa, Fb, Fc and Fd transfers to the rear spaces Rb, Rc, Rd and Ra through the connecting pipes 20*a*, 20*b*, 20*c* and 20*d*, respectively, and the heat accumulator takes away the heat from the operating gas to which the ordinary temperature water in the first jacket 16 has given off its heat. At the same time, as illustrated in FIG. 3, the operating gas in the rear spaces Ra, Rb, Rc and Rd transfers to the front spaces Fd, Fa, Fb and Fc through the connecting pipes 20*d*, 20*a*, 20*b* and 20*c*, respectively, and the heat accumulator gives off its heat to the operating gas from which the another ordinary temperature water in the second jacket 17 has taken away the heat. All in all, the first indoor apparatus is used to cool the room by circulating the thusly cooled water, and the second indoor apparatus is used to heat the another room by circulating the thusly heated water.

Also in the Second Preferred Embodiment according to the present double-headed and swash plate type Stirling engine, it is apparent that the construction is simplified identically to that of the First Preferred Embodiment.

Having now fully described the present invention, it will be apparent to one of ordinary skill in the art that many changes and modifications can be made thereto without departing from the spirit or scope of the present invention as set forth herein including the appended claims.

What is claimed is:

1. A double-headed and swash plate type Stirling engine, comprising:

a cylinder block including a heat insulator disposed at a central portion in an axial direction, an axial central hole, a plurality of bores disposed in parallel with the axial central hole, and a swash plate chamber formed therein and opened to a center of the bores;

a front housing enclosing a front end of said cylinder block;

a rear housing enclosing a rear end of said cylinder block;

a shaft rotatably disposed in said axial central hole of said cylinder block;

a swash plate fixed around said shaft, and disposed rotatably in said swash plate chamber of said cylinder block;

a plurality of double-headed pistons coupled to said swash plate by shoes, and disposed reciprocally in said bores of said cylinder block;

a plurality of front spaces formed by said front housing, said bores and a front end of said double-headed pistons in said cylinder block, and containing an operating gas therein;

a plurality of rear spaces formed by said rear housing, said bores and a rear end of said double-headed pistons in said cylinder block, and containing said operating gas therein;

a first heat exchanger for carrying out heat exchange around said front spaces;

a second heat exchanger for carrying out heat exchange around said rear spaces; and a plurality of connecting pipes connecting said front spaces to said rear spaces with a predetermined phase difference, each of said plurality of connecting pipes and the connected front and rear spaces having a constant volume, and including a heat accumulator disposed between said front spaces and said rear spaces.

2. The double-headed and swash plate type Stirling engine according to claim 1, wherein said shaft is an output shaft, said first heat exchanger heats said front spaces, and said second heat exchanger cools said rear spaces, whereby said Stirling engine operates as a prime mover.

3. The double-headed and swash plate type Stirling engine according to claim 1, wherein said shaft is a driving shaft, said first heat exchanger radiates the heat of said front spaces, and said second heat exchanger receives the heat of said rear spaces, whereby said Stirling engine operates as a cooler or a heater.

4. The double-headed and swash plate type Stirling engine according to claim 1, wherein said first heat exchanger is a fluid passage formed in said cylinder block and said front housing, and said second heat exchanger is a fluid passage formed in said cylinder block and said rear housing.

5. The double-headed and swash plate type Stirling engine according to claim 1, wherein said connecting pipes connect said front spaces to said rear spaces with a phase difference of 90°.

6. The double-headed and swash plate type Stirling engine according to claim 1, wherein said bores and said double-headed pistons are provided in a quantity of four, respectively.

7. A double-headed and swash plate type Stirling engine, comprising:

a cylinder block including a heat insulator disposed at a central portion in an axial direction, an axial central hole, a plurality of bores disposed in parallel with the axial central hole, and a swash plate chamber formed therein and opened to a center of the bores;

a front housing enclosing a front end of said cylinder block;

a rear housing enclosing a rear end of said cylinder block;

an output shaft rotatably disposed in said axial central hole of said cylinder block;

a swash plate fixed around said shaft, and disposed rotatably in said swash plate chamber of said cylinder block;

a plurality of double-headed pistons coupled to said swash plate by shoes, and disposed reciprocally in said bores of said cylinder block;

a plurality of front spaces formed by said front housing, said bores and a front end of said double-headed pistons in said cylinder block, and containing an operating gas therein;

a plurality of rear spaces formed by said rear housing, said bores and a rear end of said double-headed pistons in said cylinder block, and containing said operating gas therein;

a heating means for heating said front spaces;

a cooling means for cooling said rear spaces; and a plurality of connecting pipes connecting said front spaces to said rear spaces with a predetermined phase difference, each of said plurality of connecting pipes and the connected front and rear spaces having a constant volume, and including a heat accumulator disposed between said front spaces and said rear spaces.

8. The double-headed and swash plate type Stirling engine according to claim 7, wherein said heating means is a fluid passage formed in said cylinder block and said front housing, and said cooling means is a fluid passage formed in said cylinder block and said rear housing.

9. The double-headed and swash plate type Stirling engine according to claim 7, wherein said connecting pipes connect said front spaces to said rear spaces with a phase difference of 90°.

10. The double-headed and swash plate type Stirling engine according to claim 7, wherein said bores and said double-headed pistons are provided in a quantity of four, respectively.

11. A double-headed and swash plate type Stirling engine, comprising:

a cylinder block including a heat insulator disposed at a central portion in an axial direction, an axial central hole, a plurality of bores disposed in parallel with the axial central hole, and a swash plate chamber formed therein and opened to a center of the bores;

a front housing enclosing a front end of said cylinder block;

a rear housing enclosing a rear end of said cylinder block;

a driving shaft rotatably disposed in said axial central hole of said cylinder block;

a swash plate fixed around said shaft, and disposed rotatably in said swash plate chamber of said cylinder block;

a plurality of double-headed pistons coupled to said swash plate by shoes, and disposed reciprocally in said bores of said cylinder block;

a plurality of front spaces formed by said front housing, said bores and a front end of said double-headed pistons in said cylinder block, and containing an operating gas therein;

a plurality of rear spaces formed by said rear housing, said bores and a rear end of said double-headed pistons in said cylinder block, and containing said operating gas therein;

a heat radiating means for radiating the heat of said front spaces;

a heat receiving means for receiving the heat of said rear spaces; and a plurality of connecting pipes connecting said front spaces to said rear spaces with a predetermined phase difference, each of said plurality of connecting pipes and the connected front and rear spaces having a constant volume, and including a heat accumulator disposed between said front spaces and said rear spaces.

12. The double-headed and swash plate type Stirling engine according to claim 11, wherein said heat radiating means is a fluid passage formed in said cylinder block and said front housing, and said heat receiving means is a fluid passage formed in said cylinder block and said rear housing.

13. The double-headed and swash plate type Stirling engine according to claim 11, wherein said connecting pipes connect said front spaces to said rear spaces with a phase difference of 90°.

14. The double-headed and swash plate type Stirling engine according to claim 11, wherein said bores and said double-headed pistons are provided in a quantity of four, respectively.

* * * * *